US009548174B2

(12) United States Patent
Gaudefroy et al.

(10) Patent No.: US 9,548,174 B2
(45) Date of Patent: Jan. 17, 2017

(54) CONTRACTOR ASSEMBLY WHICH COUNTERACTS ELECTROMAGNETIC REPULSION OF CONTACTS

(71) Applicant: TYCO ELECTRONICS CORPORATION, Berwyn, PA (US)

(72) Inventors: Herve Gabriel Gaudefroy, Santa Barbara, CA (US); Marcus Priest, Carpinteria, CA (US); Tien Duc Ngo, Oxnard, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/694,502

(22) Filed: Apr. 23, 2015

(65) Prior Publication Data

US 2016/0314924 A1 Oct. 27, 2016

(51) Int. Cl.

| | |
|---|---|
| ***H01H 3/00*** | (2006.01) |
| ***H01H 50/54*** | (2006.01) |
| ***H01H 50/60*** | (2006.01) |
| ***H01H 50/02*** | (2006.01) |

(52) U.S. Cl.

CPC ..... *H01H 50/546* (2013.01); *H01H 50/02* (2013.01); *H01H 50/60* (2013.01)

(58) Field of Classification Search

CPC ..... H01H 50/54; H01H 50/04; H01H 9/443; H01H 3/222; H01H 50/546; H01H 2050/025; H01H 2001/545

See application file for complete search history.

(56) References Cited

U.S. PATENT DOCUMENTS

| | | | | |
|---|---|---|---|---|
| 8,816,801 | B2 | 8/2014 | Tachikawa et al. | |
| 2004/0066261 | A1* | 4/2004 | Nishida | H01H 51/2209 335/179 |
| 2013/0113580 | A1* | 5/2013 | Naka | H01H 1/54 335/196 |
| 2013/0335175 | A1* | 12/2013 | Tachikawa | H01H 1/54 335/147 |

FOREIGN PATENT DOCUMENTS

WO 96/06441 A1 2/1996

OTHER PUBLICATIONS

International Search Report, International Application No. US/2016/027461, International Filing Date, Apr. 14, 2016.

* cited by examiner

*Primary Examiner* — Bernard Rojas

(57) ABSTRACT

A switch assembly adapted and a method for switching power to a circuit having a power source. The switch assembly includes current carrying contacts and a coupling member. The coupling member has conductive pads for engaging the current carrying contacts and a contact bridge extending between the conductive pads. An actuator assembly moves the coupling member between a closed position in which the conductive pads of the coupling member engage the current carrying contacts and an open position in which the conductive pads of the coupling member are disengaged from the current carrying contacts. Opposing electromagnetic forces are generated between the contact bridge and the conductive pads to resist electromagnetic repulsion forces generated between the current carrying contacts and the conductive pads as the actuator assembly approaches or is in the closed position.

13 Claims, 6 Drawing Sheets

CONTRACTOR ASSEMBLY WHICH COUNTERACTS ELECTROMAGNETIC REPULSION OF CONTACTS

FIELD OF THE INVENTION

The present invention relates to a relay or switch. In particular, the invention relates to a contactor and a method which uses electromagnetic forces to resist the electromagnetic repulsion of the contacts.

BACKGROUND OF THE INVENTION

Relays and contactors are known devices used for switching of intended circuits/loads and the like. A relay is an electrically operated switch. Many known relays use an electromagnet to operate a switching mechanism mechanically, but other operating principles are also used. Relays are used where it is necessary to control a circuit by a low power signal or where several circuits must be controlled by one signal. A contactor is an electrically controlled switch used for switching a power circuit, similar to a relay except with higher current ratings.

In general, a simple electromagnetic relay consists of a coil assembly, a movable armature and one or more sets of contacts, i.e. single throw system, double throw system, etc. The sets of contact include movable contacts, fixed normally open contacts and fixed normally closed contacts. The armature is mechanically linked to one or more sets of moving contacts and is held in place by a spring.

When an electric current is passed through the coil assembly it generates a magnetic field that attracts the armature. The consequent movement of the movable contact (s) either makes or breaks (depending upon construction) a connection with a fixed contact(s). If the set of contacts was closed when the relay was de-energized, then the movement opens the contacts and breaks the connection, and vice versa if the contacts were open. When the current to the coil is switched off, the armature is returned by the spring force of the return spring toward its relaxed position. Usually this force is provided by a spring, but gravity is also used commonly in industrial motor starters. Most relays and contactors are manufactured to operate quickly. In a low-voltage application, this reduces noise; in a high voltage or current application, it reduces arcing. In order to allow the proper movement of the contacts, the spring force is designed to be less than the force generated by the coil.

However, in many contactors, electromagnetic repulsion generated by the constriction of the flow of current through the contacts can prevent or inhibit the contacts from closing properly or can cause the contact to improperly open due to a large transient pulse applied during operation. Generally in such applications, a large spring force of a contact spring is provided to overcome or counteract the electromagnetic repulsion. The large spring force provides contact pressure between the movable contactor and the fixed contactor, thereby maintaining the contacts in a closed position.

In order to increase the contact pressure generated by the contact spring, the size of the spring must be increased. Consequently, the force generated by an electromagnet, which drives the movable contactor, must also be increased, requiring a larger electromagnet. This results in the size of the entire structure being increased.

It would therefore be beneficial to provide a contactor assembly in which the contacts are maintained in a closed position without the need to increase the size of the assembly. In particular, it would be beneficial to provide a contact assembly which uses electromagnetic forces to resist or counteract the electromagnetic repulsion of the contacts.

SUMMARY OF THE INVENTION

An embodiment is directed to a contactor assembly adapted for switching power to a circuit having a power source. The contactor assembly includes a housing with current carrying contacts disposed therein. The current carrying contacts include conductive bodies that protrude from the housing. A coupling member includes conductive pads for engaging the current carrying contacts and a contact bridge which extends between the conductive pads. An actuator assembly moves the coupling member between a closed position in which the conductive pads of the coupling member engage the current carrying contacts and an open position in which the conductive pads of the coupling member are disengaged from the current carrying contacts. Opposing electromagnetic forces are generated between the contact bridge and the conductive pads to resist electromagnetic repulsion forces generated between the current carrying contacts and the conductive pads when the actuator assembly is in the closed position.

An embodiment is directed to a switch assembly adapted for switching power to a circuit having a power source. The switch assembly includes current carrying contacts and a coupling member. The coupling member has conductive pads for engaging the current carrying contacts and a contact bridge extending between the conductive pads. An actuator assembly moves the coupling member between a closed position in which the conductive pads of the coupling member engage the current carrying contacts and an open position in which the conductive pads of the coupling member are disengaged from the current carrying contacts. Opposing electromagnetic forces are generated between the contact bridge and the conductive pads to resist electromagnetic repulsion forces generated between the current carrying contacts and the conductive pads as the actuator assembly approaches or is in the closed position.

An embodiment is directed to a method of activating a switch assembly adapted for switching power to a circuit having a power source. The method includes: moving a coupling member from an open position to a closed position; electrically coupling contact pads of the coupling member to stationary current carrying contacts of the switch assembly as the coupling member approaches the closed position; creating electromagnetic repulsion forces between the contact pads and the current carrying contacts; and creating opposing electromagnetic forces which act upon the conductive pads to oppose the electromagnetic repulsion forces. Wherein as the opposing electromagnetic force counteracts the electromagnetic repulsion force, the opposing electromagnetic force prevents or eliminates the bouncing of the conductive pads from the current carrying contacts during the mating of the conductive pad with the current carrying contacts, allowing the mating to be more easily predicted and controlled.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
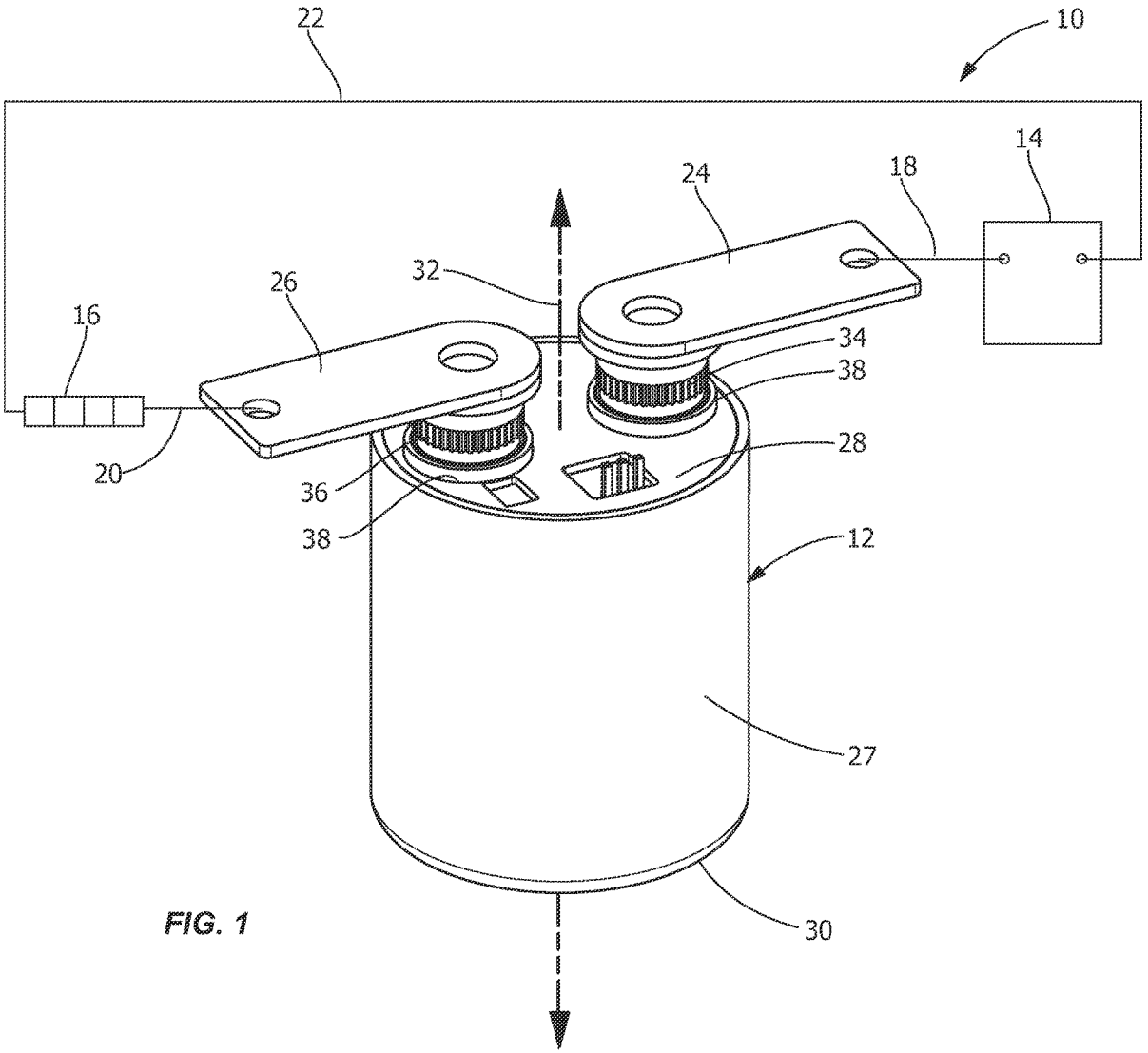
FIG. 1 is a schematic diagram of a circuit that includes a contactor assembly in accordance with one embodiment of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 is a schematic diagram of a circuit 10 that includes a contactor or switch assembly 12 in accordance with one embodiment of the present disclosure. The circuit 10 includes a power source 14 that is electrically coupled with one or more electrical loads 16 via conductive pathways 18, 20, 22 and the contactor assembly 12. The power source 14 may be any of a variety of systems, devices and apparatuses that supply electric current to power the electrical load 16. For example, the power source 14 may be a battery that supplies direct current (DC) or alternating current (AC) to the electrical load 16.

Figure 3:
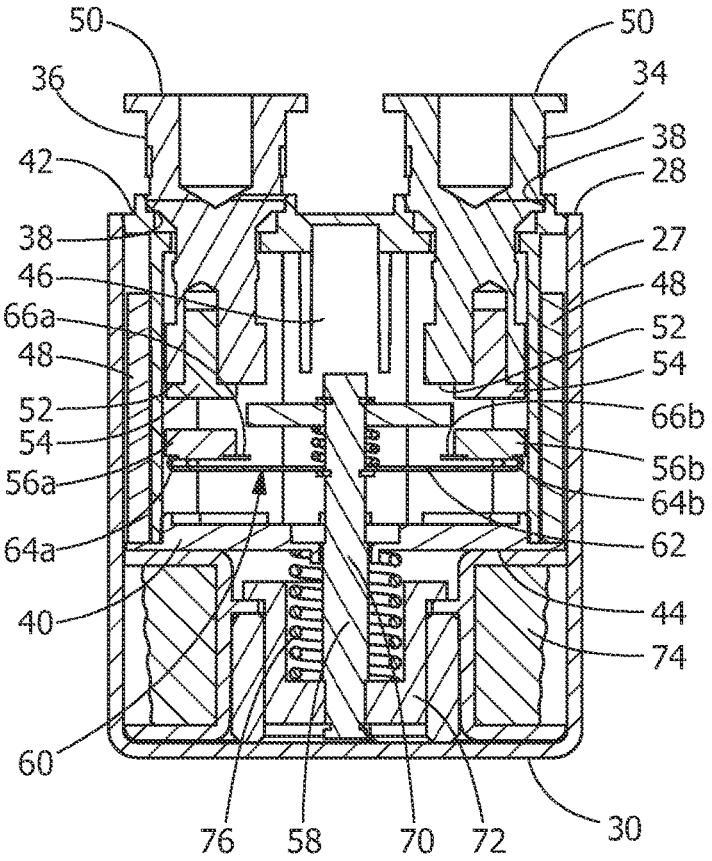
FIG. 3 is a cross-sectional view of the contactor assembly along line 3-3 shown in FIG. 2, illustrating the contactor assembly in an open position.
Figure 4:
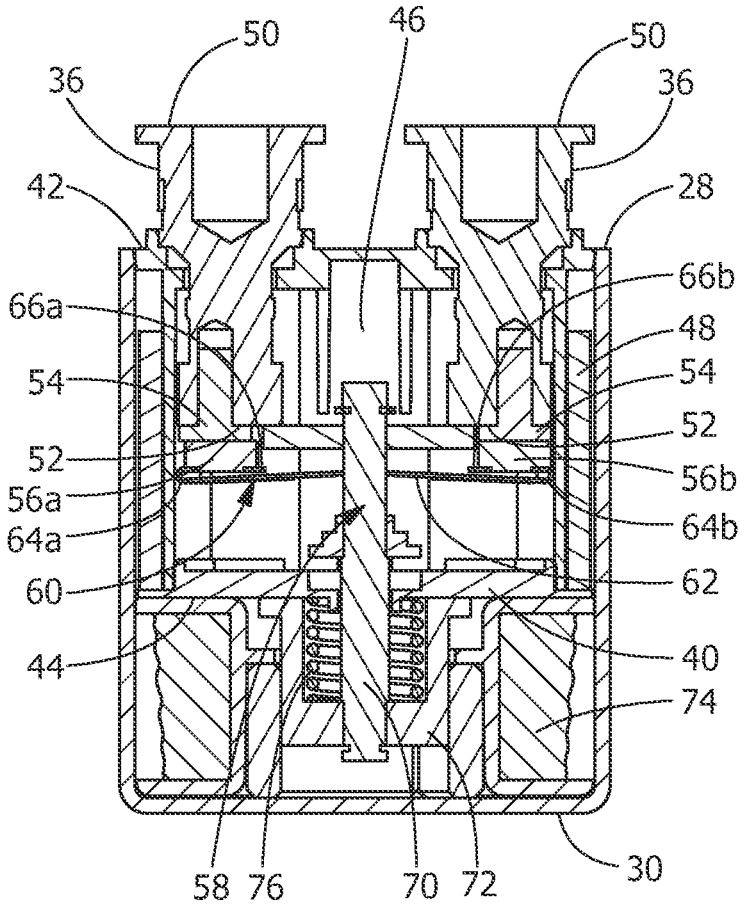
FIG. 4 is a cross-sectional view of the contactor assembly, similar to that shown in FIG. 3, illustrating the contactor assembly in a closed position.
Figure 5:
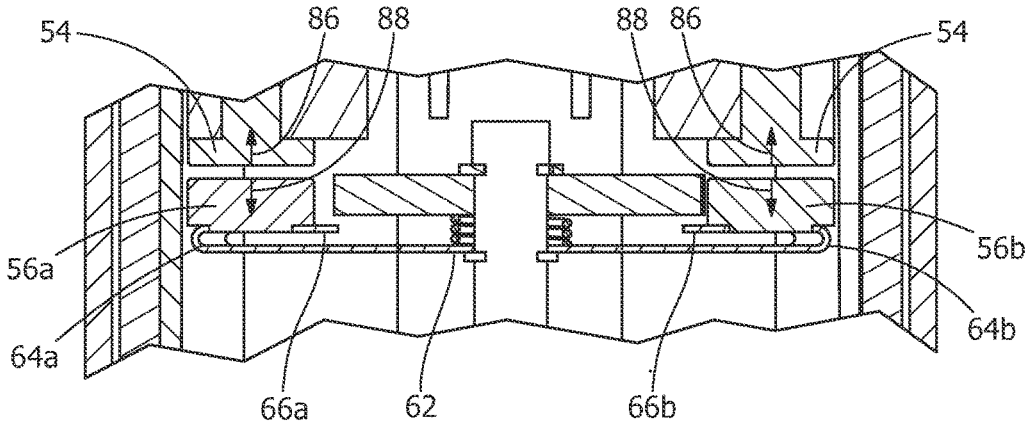
FIG. 5 is an enlarged cross-sectional view of contacts and a coupling member of the contactor assembly.
Figure 6:
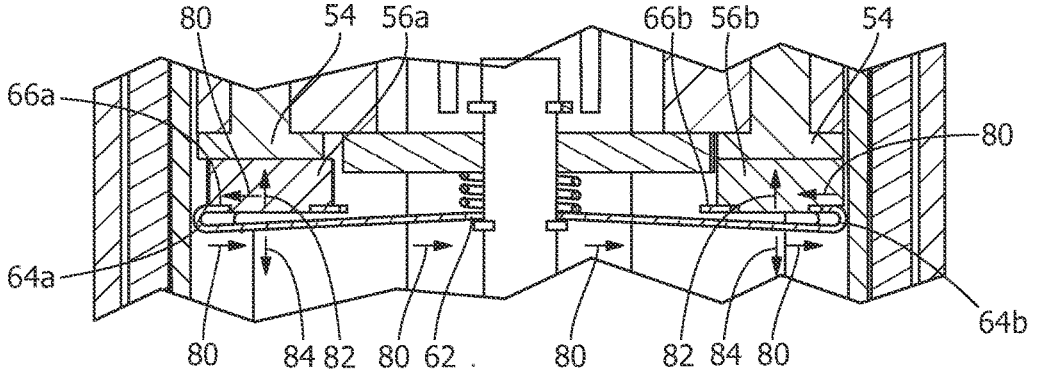
FIG. 6 is an enlarged cross-sectional view of contacts and a coupling member of the contactor assembly of FIG. 4 shown in the closed position.

The conductive pathways 18, 20, 22 may include any of a variety of conductive bodies capable of transmitting electric current. For example, the conductive pathways 18, 20, 22 may include wires, cables, bus bars, contacts, connectors and the like. The contactor assembly 12 is a relay or switch that controls the delivery of power through the circuit 10. The contactor assembly 12 is joined with the power source 14 and the electrical load 16 by the conductive pathways 18, 20. In the illustrated embodiment, bus bars 24, 26 couple the conductive pathways 18, 20 with the contactor assembly 12. Alternatively, a different number of bus bars 24, 26 may be used or a different component or assembly may be used to electrically join the contactor assembly 12 with the circuit 10. The contactor assembly 12 alternates between an open state (as shown in FIGS. 3 and 5) and a closed state (as shown in FIGS. 4 and 6). In a closed state, the contactor assembly 12 provides a conductive bridge between the conductive pathways 18, 20, or between the bus bars 24, in order to close the circuit 10 and permit current to be supplied from the power source 14 to the electrical load 16. In the open state, the contactor assembly 12 removes the conductive bridge between the pathways 18, 20, or between the bus bars 24, such that the circuit 10 is opened and current cannot be supplied from the power source 14 to the electrical load 16 via the contactor assembly 12.

Figure 2:
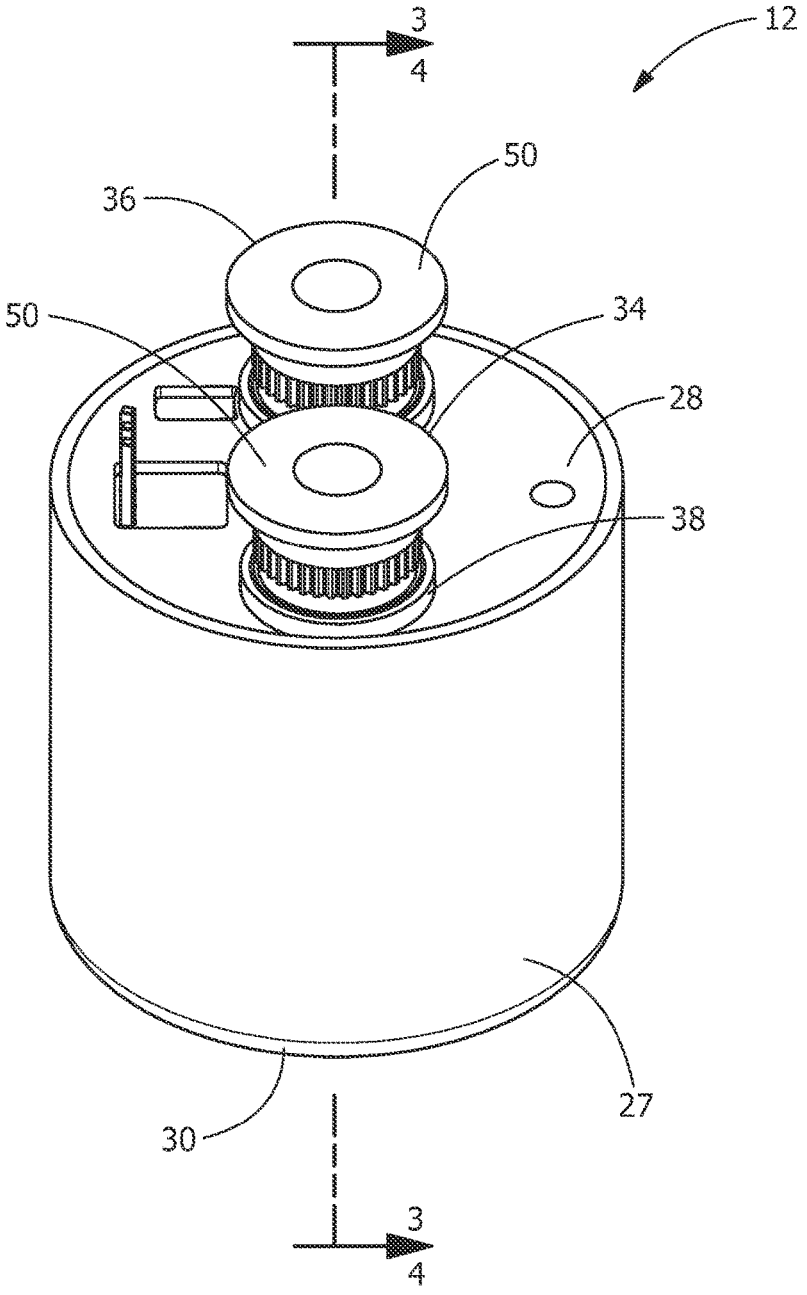
FIG. 2 is a perspective view of the contactor assembly shown in FIG. 1, with the bus bars removed.

The illustrative contactor assembly 12 shown in FIG. 1 includes an outer housing 27 that extends between opposite ends 28, 30 along a longitudinal axis 32. While the outer housing 27 is shown in the approximate shape of a cylindrical can, alternatively the outer housing 27 may have a different shape. The outer housing 27 may include, or be formed from, a dielectric material such as one or more polymers. In another embodiment, the outer housing 27 may include or be formed from conductive materials, such as one or more metal alloys. As described below, the contactor assembly 12 includes a set of current carrying contacts 34, 36 (shown in FIG. 2) that convey current through the contactor assembly 12. The contacts 34, 36 close and open the circuit 10.

The end 28 of the housing 27 includes several openings 38 through which the contacts 34, 36 extend. The contacts 34, 36 extend through the openings 38 to mate with conductive bodies that are joined with the circuit 10 such as the bus bars 24, 26 (shown in FIG. 1). In the illustrated embodiment, the contact 34 mates with bus bar 24 while the contact 36 mates with bus bar 26.

Referring to FIGS. 3 and 4, the contactor assembly 12 includes an inner housing 40 disposed within the outer housing 27. The inner housing 40 may extend between opposite ends 42, 44. The contacts 34, 36 protrude through the end 42 of the inner housing 40 to be presented at the end 28 of the outer housing 27. The inner housing 40 may include, or be formed from, a dielectric material such as one or more polymers. The inner housing 40 includes an interior chamber or compartment 46.

The contacts 34, 36 are disposed in the interior compartment 46. The interior compartment 46 may be sealed and loaded with an inert and/or insulating gas, such as, but not limited to, sulphur hexafluoride, nitrogen and the like. The interior compartment 46 is sealed so that any electric arc extending from the contacts 34, 36 are contained within the interior compartment 46 and do not extend out of the interior compartment 46 to damage other components of the contactor assembly 12 or circuit 10 (shown in FIG. 1).

In the illustrated embodiment, permanent magnets 48 are provided on opposite sides of the interior compartment 46 (shown in FIG. 3). Alternatively, the magnets 48 may be electromagnets or other source of a magnetic flux.

The contactor assembly 12 shown and described herein is provided for illustrative purposes. The configuration of the contactor assembly 12 and its components may vary without departing from the scope of the invention.

As best shown in FIGS. 3 through 5, the contacts 34, 36 are elongated bodies that extend between mating ends 50 and engagement ends 52. The mating ends 50 couple with the circuit 10 (shown in FIG. 1) to electrically couple the contactor assembly 12 with the circuit 10. For example, the mating ends 50 may be joined with the bus bars 24 (shown in FIG. 1). In the illustrated embodiment, the engagement ends 52 include conductive pads 54. The conductive pads 54 include, or are formed from, a conductive material such as, but not limited to, one or more metals or metal alloys. For example, the conductive pads 54 may be formed from a silver (Ag) alloy. The use of a silver alloy may prevent the conductive pads 54 from welding to conductive pads 56 of an actuator subassembly 58. Alternatively, the conductive pads 54 may be made from softer material, such as, but not limited to, copper or copper alloys, as will be more fully described.

In the illustrative embodiment shown, the actuator subassembly 58 moves along or in directions parallel to the longitudinal axis 32 to electrically couple contacts 34, 36 with one another. The actuator assembly 58 includes a coupling member 60.

Figure 7:
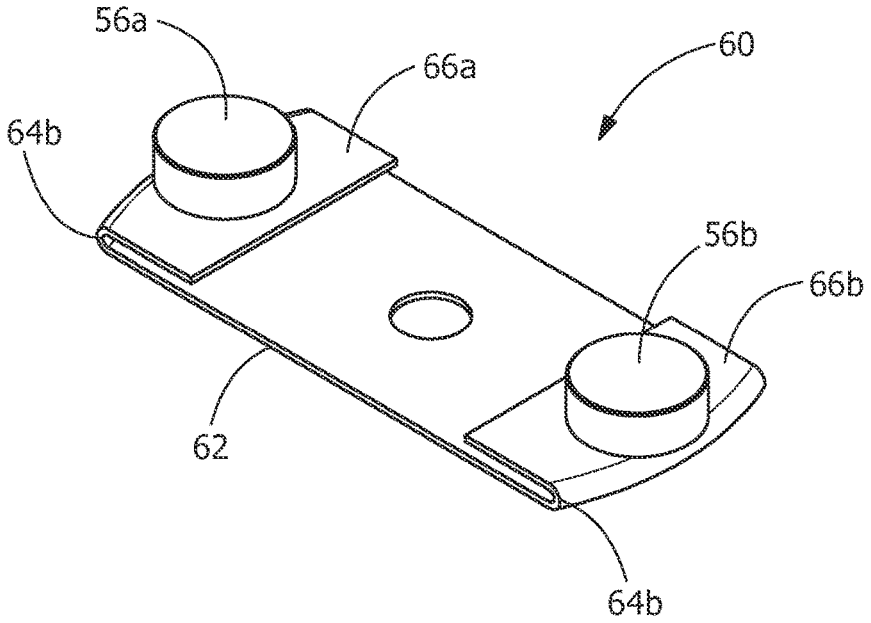
FIG. 7 is a perspective view of the coupling member.

The coupling member 60, as best shown in FIG. 7, has a contact bridge 62 which extends from one curved section 64 to a second curved section 64. Mating members 66 extend from the end of the curved sections 64 which are not in contact with the contact bridge 62. Respective mating members 66, curved sections 64 and portions of the contact bridge 62 form C-shaped members at either end of the contact bridge 62. The mating members 66 are placed in physical and electrical contact with the conductive pads 56.

The coupling member 60 includes, or is formed from, a conductive material such as, but not limited to, one or more metals or metal alloys. The coupling member 60 includes the conductive pads 56 on opposite ends of the coupling member 60. The conductive pads 56 include, or are formed from, a conductive material such as, but not limited to, one or more metals or metal alloys. For example, the conductive pads 56 may be formed from a silver (Ag) alloy. The use of a silver alloy may prevent the conductive pads 56 from welding to conductive pads 54. Alternatively, the conductive pads 56 may be made from softer material than that of the coupling member 60, such as, but not limited to, copper or copper alloys, as will be more fully described. The conductive pads 56 may be placed in physical and electrical connection with the mating members 66 of the coupling member 60 by using known methods, such as, but not limited to, welding.

The actuator subassembly 58 moves in opposing directions along the longitudinal axis 32 to move the coupling member 60 toward the contacts 34, 36 (closed position, FIGS. 4 and 6) and away from the contacts 34, 36 (open position, FIGS. 3 and 5). For example, the actuator subassembly 58 may move toward the engagement ends 52 of the contacts 34, 36 to lift the coupling member 60 toward the engagement ends 52.

The mating of the conductive pads 56 of the coupling member 60 with the conductive pads 54 of the contacts 34, 36 causes the current to flow across the coupling member 60 of the actuator subassembly 58, thereby closing the circuit 10. In the illustrated embodiment, the conductive pads 56 and the coupling member 60 electrically joins the contacts 34, 36 with one another such that current may flow through the conductive pads 54 of the contacts 34, 36, through the conductive pads 56, through the mating members 66, through the curved sections 64 and across the contact bridge 62. The current may flow in either direction.

FIG. 3 is a cross-sectional view of the contactor subassembly 12 in an open state in accordance with one embodiment of the present disclosure. The actuator subassembly 58 includes an elongated shaft 70 that is oriented along the longitudinal axis 32. The coupling member 60 is joined to the shaft 70 at one end using a clip or other known method.

As shown in FIG. 5, the contactor assembly 12 is in an open state because the actuator subassembly 58 is decoupled from contacts 34, 36. The actuator subassembly 58 is separated from the contacts 34, 36 such the coupling members 60 does not interconnect or electrically connect the contacts 34, 36 with one another. As a result, current cannot pass across the contacts 34, 36.

The actuator subassembly 58 includes a magnetized body 72 coupled to the shaft or armature 70. The body 72 may include a permanent magnet that generates a magnetic field or flux oriented along the longitudinal axis 32. The contactor assembly 12 includes a coil body 74 that encircles the body 72. The coil body 74 may be used as an electromagnet to drive the magnetic body 72 of the shaft 70 along the longitudinal axis 32. For example, the coil body 74 may include conductive wires or other components that encircle the magnet body 72. An electric current may be applied to the coil body 74 to create a magnetic field that is oriented along the longitudinal axis 32. Depending on the direction of the current passing through the coil body 74, the magnetic field induced by the coil body 74 may have magnetic north oriented upward toward the end 28 of the outer housing 27 or downward toward the end 30.

In order to drive the actuator subassembly 58 toward the contacts 34, 36, the coil body 74 is energized to create a magnetic field along the longitudinal axis 32. The magnetic field may move the magnet body 72 of the actuator assembly 58 toward the contacts 34, 36 along the longitudinal axis 32. In the illustrated embodiment, a armature spring 76 exerts a force on the armature 70 in a downward direction toward the end 30 of the outer housing 27. The force exerted by the armature spring 76 prevents the actuator subassembly 58 from moving toward and mating with the contacts 34, 36 without the creation of a magnetic field by the coil body 74. The magnetic field generated by the coil body 74 is sufficiently large or strong so as to overcome the force exerted on the armature 70 by the armature spring 76 and drive the armature 70 and the actuator subassembly 58 toward the contacts 34, 36.

FIG. 4 is a cross-sectional view of the contactor assembly 12 in a closed state in accordance with one embodiment of the present disclosure. In the closed state, the actuator subassembly 58 has moved within the contactor assembly 12 along the longitudinal axis 32 sufficiently far that the conductive pads 56 of the coupling member 60 are mated with conductive pads 54 of the contacts 34, 36. As a result, the actuator subassembly 58 has electrically coupled contacts 34, 36 to close the circuit 10.

In the closed position, the current flows, as indicated by the arrows 80 of FIG. 5, through conductive pad 54 of contact 34, through conductive pad 56*a*, through mating member 66*a*, through curved section 64*a*, across contact bridge 62, through curved section 64*b*, through mating member 66*b*, through conductive pad 56*b* and through conductive pad 54 of contact 36. As this occurs, opposing electromagnetic forces 82, 84 are generated between the conductive pads 56 (including the mating members 66) and the contact bridge 62. These forces (i.e. Lorentz forces) resist the electromagnetic repulsion force 86, 88 which is generated as the current flows across the conductive pads 54 and conductive pads 56.

As the contactor assembly 12 is moved to the closed position, the conductive pads 56 of the coupling member 60 are moved into engagement with the conductive pads 54 of the contacts 34, 36. As the conductive pads 56 approach the conductive pads 54, current begins to flow from the conductive pad 54 of contact 34 to conductive pad 56*a*. As this occurs, the flow of current creates electromagnetic repulsion forces 82 which oppose the mating of the conductive pad 54 of contact 34 with the conductive pad 56*a* of the coupling member 60. In contactors known in the art, the electromagnetic repulsion forces can result in the conductive pad 56*a* being pushed away from or bounced from conductive pad 54, causing the current to jump across or arc between the conductive pads, thereby causing damage or welding of the conductive pads.

When the contacts 34, 36 close or open the circuit 10, the initial transfer of relatively high current that is supplied by the power source 14 across the contacts 34, 36 may cause the contacts 34, 36 to arc, or create an electric arc that extends from one or more of the contacts 34, 36 within the contactor assembly 12. For example, the gas or atmosphere within the contactor assembly 12 that surrounds the contacts 34, 36 may electrically break down and permit the electric charge surging through the contacts 34, 36 to jump or move across the gas or atmosphere. The arcing may produce an ongoing plasma discharge that results from current flowing through normally nonconductive media such as the gas or atmosphere. The arcing can result in a very high temperature that may be capable of melting, welding, vaporizing or damaging components within the contactor assembly 12, including the contacts 34, 36.

The configuration of the coupling member 60 of the present invention prevents, reduces or eliminates the conductive pad 56*a* from being pushed away or bounced from the conductive pad 54. This allows for a much more reliable and effective electrical connection to occur between the conductive pad 56*a* and the conductive pad 54 of the contact 34, thereby reducing the opportunity for arcing to occur across the conductive pads.

As the conductive pad 54 of the contact 34 is placed in electrical engagement with the conductive pad 56*a*, the current flows through mating member 66*a*, through curved section 64*a* and across contact bridge 62, as shown in FIG. 6. As the current flow through the conductive pad 56*a* and mating member 66*a* is in an opposite direction to the flow of current through the contact bridge 62, and as the conductive pad 56*a* and mating member 66*a* are positioned proximate to and essentially parallel to the contact bridge 62, the flow of current creates opposing forces 82. The opposing force 82 which acts upon the conductive pad 56*a* is opposed to the repulsion force 86 which acts on the conductive pad 56*a*. The repulsion forces are generated by the constriction of the flow of the current through the conductive pads. As the opposing force 82 counteracts the repulsion force 86, the mating of the conductive pad 56*a* with the conductive pad 54 can be more easily predicted and controlled, as the opposing force 80 prevents or eliminates the repulsion or bouncing of the conductive pad 56*a* from the conductive pad 54 during mating. As the bouncing of the conductive pad 56*a* is controlled or eliminated, arcing across the conductive pad 56*a* and the conductive pad 54 is also controlled or eliminated.

In addition, if a large transient pulse current or other large current is applied across the conductive pads 54, 56*a* during operation, the increased repulsion force 86 will be counteracted by the increased opposing force 82, thereby maintaining the conductive pads 54 and 56*a* in physical and electrical contact during operation, thereby preventing unwanted movement of the conductive pad 56*a* and the coupling member 60 from the closed position toward the open position, which in turn prevents unwanted arcing between the conductive pads.

As the bouncing, separation and arcing between the conductive pads 54 and the conductive pads 56*a* is controlled, the conductive pads are not subjected to the very high temperature associated with arcing. Consequently, softer and more conductive material can be used for the conductive pads.

In addition, the conductive pads 56 nearer to the conductive pads 54, current begins to flow from the conductive pad 56*b* to the conductive pad 54 of contact 36. As this occurs, the flow of current creates repulsion forces 88 which oppose the mating of the conductive pad 54 of contact 36 with the conductive pad 56*b* of the coupling member 60. In contactors known in the art, the repulsion forces can result in the conductive pad 56*b* being pushed away from or bounced from conductive pad 54, causing the current to jump across or arc between the conductive pads, thereby causing damage or welding of the conductive pads.

The configuration of the coupling member 60 of the present invention, prevents, reduces or eliminates the conductive pad 56*b* from being pushed away or bounced from the conductive pad 54 of contact 36. This allows for a much more reliable and effective electrical connection to occur between the conductive pad 56*b* and the conductive pad 54 of the contact 36, thereby reducing the opportunity for arcing to occur across the conductive pads.

As the conductive pad 56*b* is placed in electrical engagement with the conductive pad 54 of the contact 36, the current flows across contact bridge 62, through curved section 64*b* and through mating member 66*b*, as shown in FIG. 5. As the current flow through the conductive pad 56*b* and mating member 66*b* is in an opposite direction to the flow of current through the contact bridge 62, and as the conductive pad 56*b* and mating member 66*b* are positioned proximate to and essentially parallel to the contact bridge 62, the flow of current creates opposing forces 82, 84. The opposing electromagnetic force 82 which acts upon the conductive pad 56*b* is opposed to the electromagnetic repulsion force 88 which acts on the conductive pad 56*b*. The repulsion forces are generated by the constriction of the flow of the current through the conductive pads. As the opposing force 82 counteracts the repulsion force 88, the mating of the conductive pad 56*b* with the conductive pad 54 of the contact 36 can be more easily predicted and controlled, as the opposing force 82 prevents or eliminates the repulsion or bouncing of the conductive pad 56*b* from the conductive pad 54 during mating. As the bouncing of the conductive pad 56*b* is controlled or eliminated, arcing across the conductive pad 56*b* and the conductive pad 54 is also controlled or eliminated.

In addition, if a large transient pulse current or other large current is applied across the conductive pads 54, 56*b* during operation, the increased repulsion force 88 will be counteracted by the increased opposing force 82, thereby maintaining the conductive pads 54 and 56*b* in physical and electrical contact during operation, thereby preventing unwanted movement of the conductive pad 56*b* and the coupling member 60 from the closed position toward the open position.

As the bouncing, separation and arcing between the conductive pads 54 and the conductive pads 56*b* is controlled, the conductive pads are not subjected to the very high temperature associated with arcing. Consequently, softer and more conductive material can be used for the conductive pads.

The forces generated by the current flow through the coupling member 60 counteract repulsion forces generated by the constriction of the flow of the current. This allows the contacts to be moved to a closed position without damage to the conductive pads. In addition, the contacts are maintained in a closed position, even when a large transit pulse is applied.

While the coupling member 60 is shown in use with the illustrative contactor assembly 12, the configuration of the coupling member 60 and the use of the opposing forces to provide an enhanced electrical connection, e.g. minimizing bounce between the conductive pads and preventing the unwanted disengagement of the conductive pads thereby reducing arcing and damage to the conductive pads, can be used in many different applications and with many different type of electrical connectors in which contacts are moved between an open and a closed position.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions and sizes, and with other elements, materials and components, without departing from the spirit or essential characteristics thereof. One skilled in the art will appreciate that the invention may be used with many modifications of structure, arrangement, proportions, sizes, materials and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and not limited to the foregoing description or embodiments.

The invention claimed is:

1. A contactor assembly adapted for switching power to a circuit having a power source, the contactor assembly comprising:

a housing;

current carrying contacts disposed in the housing, the current carrying contacts including conductive bodies that protrude from the housing;

a coupling member, the coupling member having conductive pads for engaging the current carrying contacts, a contact bridge extends from a first curved section of the coupling member to a second curved section of the coupling member, mating members extend from ends of the curved sections which are not in contact with the contact bridge, the conductive pads are mounted on the mating members, the mating members are spaced from the contact bridge, the conductive pads extend in a direction toward the current carrying contacts and away from the contact bridge section;

an actuator assembly which moves the coupling member between a closed position in which the conductive pads of the coupling member engage the current carrying contacts and an open position in which the conductive pads of the coupling member are disengaged from the current carrying contacts;

opposing electromagnetic forces generated between the contact bridge and the conductive pads to resist electromagnetic repulsion forces generated between the current carrying contacts and the conductive pads when the actuator assembly is in the closed position.

2. The contactor assembly of claim 1, wherein the conductive pads are formed from a conductive material which is softer than a conductive material of the contact bridge.

3. The contactor assembly of claim 1, wherein the mating members and curved sections form C-shaped members at either end of the contact bridge.

4. The contactor assembly of claim 1, wherein the housing includes an interior compartment with internal walls which laterally extend within the interior compartment to define a protection chamber, the coupling member is disposed in the protection chamber of the housing.

5. The contactor assembly of claim 4, wherein the current carrying contacts are disposed in the protection chamber of the housing, the current carrying contacts including conductive bodies that protrude from the housing and are configured to close the circuit.

6. A switch assembly adapted for switching power to a circuit having a power source, the switch assembly comprising:

current carrying contacts;

a coupling member, the coupling member having conductive pads for engaging the current carrying contacts, a contact bridge extends from a first curved section of the coupling member to a second curved section of the coupling member, mating members extend from ends of the curved sections which are not in contact with the contact bridge, the conductive pads are mounted on the mating members, the mating members are spaced from the contact bridge, the conductive pads extend in a direction toward the current carrying contacts and away from the contact bridge section;

an actuator assembly which moves the coupling member between a closed position in which the conductive pads of the coupling member engage the current carrying contacts and an open position in which the conductive pads of the coupling member are disengaged from the current carrying contacts;

opposing electromagnetic forces generated between the contact bridge and the conductive pads to resist electromagnetic repulsion forces generated between the current carrying contacts and the conductive pads as the actuator assembly approaches or is in the closed position.

7. The switch assembly of claim 6, wherein the mating members and curved sections form C-shaped members at either end of the contact bridge.

8. The switch assembly of claim 7, wherein the conductive pads are formed from a conductive material which is softer than a conductive material of the contact bridge.

9. A method of activating a switch assembly adapted for switching power to a circuit having a power source, the method comprising:

moving a coupling member from an open position to a closed position, the coupling member having conductive pads for engaging stationary current carrying contacts of the switch assembly, a contact bridge extends from a first curved section of the coupling member to a second curved section of the coupling member, mating members extend from ends of the curved sections which are not in contact with the contact bridge, the conductive pads are mounted on the mating members, the mating members are spaced from the contact bridge, the conductive pads extend in a direction toward the current carrying contacts and away from the contact bridge section;

electrically coupling the contact pads of the coupling member to the current carrying contacts as the coupling member approaches the closed position;

creating electromagnetic repulsion forces between the contact pads and the current carrying contacts;

creating opposing electromagnetic forces which act upon the conductive pads to oppose the electromagnetic repulsion forces;

wherein as the opposing electromagnetic force counteracts the electromagnetic repulsion force, the opposing electromagnetic force prevents or eliminates the bouncing of the conductive pads from the current carrying contacts during the mating of the conductive pad with the current carrying contacts, allowing the mating to be more easily predicted and controlled.

10. The method as recited in claim 9, further comprising eliminating or reducing arcing across the conductive pads and the current carrying contact.

11. The method as recited in claim 9, further comprising directing current flow through the conductive pads in an opposite direction as current flow through a contact bridge of the coupling member which connects the contact pads, wherein the opposite flow of current creates the opposing electromagnetic forces which act upon the conductive pads to oppose the electromagnetic repulsion forces.

12. The method as recited in claim 9, further comprising increasing the opposing electromagnetic force to counteract transient pulse current or other current is applied across the current carrying contacts and the conductive pads when the coupling member is in the closed position during operation, wherein unwanted movement of the conductive pads and the coupling member is prevented.

13. The method as recited in claim 11, wherein the conductive pads are formed from a conductive material which is softer than a conductive material of the contact bridge.

* * * * *